US008198522B2

(12) United States Patent
Michael

(10) Patent No.: US 8,198,522 B2
(45) Date of Patent: Jun. 12, 2012

(54) HI-HAT MUSICAL DEVICE

(76) Inventor: Christopher Allen Michael, Bozeman, MT (US)

( * ) Notice: Subject to any disclaimer, the term of this patent is extended or adjusted under 35 U.S.C. 154(b) by 104 days.

(21) Appl. No.: 12/910,500

(22) Filed: Oct. 22, 2010

(65) Prior Publication Data

US 2012/0097010 A1 Apr. 26, 2012

(51) Int. Cl.
*G10D 13/02* (2006.01)

(52) U.S. Cl. ..... 84/422.3

(58) Field of Classification Search ..... None
See application file for complete search history.

(56) References Cited

U.S. PATENT DOCUMENTS 4,497,238 A * 2/1985 Dasovich ..... 84/421
4,817,490 A * 4/1989 Cahill ..... 84/422.1
5,018,426 A * 5/1991 Suzuki ..... 84/422.3
5,267,500 A * 12/1993 Lombardi ..... 84/402
5,415,072 A * 5/1995 Huang ..... 84/422.3
5,438,903 A * 8/1995 Cropek ..... 84/422.3
5,668,332 A * 9/1997 Lombardi ..... 84/422.3
6,316,708 B1 * 11/2001 Kuppers ..... 84/422.3
6,320,109 B1 * 11/2001 Kuppers ..... 84/422.3
6,878,868 B2 4/2005 McMillan
7,094,959 B2 * 8/2006 Marnell ..... 84/422.3
7,115,805 B1 10/2006 Vandervoort
7,126,050 B1 10/2006 Lombardi
2005/0150355 A1 * 7/2005 Sutej ..... 84/422.3

* cited by examiner

*Primary Examiner* — Elvin G Enad
*Assistant Examiner* — Robert W Horn
(74) *Attorney, Agent, or Firm* — Gough, Shanahan, Johnson and Waterman; William L. MacBride, Jr.

(57) ABSTRACT

A musical operator can apply force to the hi-hat musical device to actuate the upper cymbal away from the lower cymbal creating a desired sound, by applying a motion reversal means.

The device comprises a foot pedal, motion reversal means and hi-hat stand, which said stand is further comprised of a support tube, operation rod, upper cymbal and lower cymbal, and support structure means. Each cymbal is opposingly disposed against each other in a closed non-actuated position, horizontally along the operation rod. The motion reversal means translates a downward pedal motion into an opposing upward cymbal motion, placing the upper and lower cymbals, in the open actuated position, allowing the drummer to produce an open cymbal sound when striking the cymbals, and to produce a closed cymbal sound when releasing the foot pedal, returning said cymbals to the closed non-actuated position.

6 Claims, 7 Drawing Sheets

HI-HAT MUSICAL DEVICE

FIELD OF THE INVENTION

The present invention is directed to a hi-hat musical device or instrument, relating to an apparatus for modifying the conventional hi-hat musical devices known in the industry to function in a manner opposite that of known hi-hat musical devices. The cymbals in the present invention set or rest in a non-actuated closed position, with both cymbals disposed or biasing against each other. A musical operator, player or user, hereinafter a drummer, can apply force to the hi-hat musical device to actuate the upper cymbal to the hi-hat away from the lower cymbal to create a desired open sound, when the drummer beats the cymbals with his or her drumstick.

BACKGROUND OF THE INVENTION

The hi-hat closed sound, in general, is the dominantly desired sound created by a drummer from a hi-hat musical device, with the created open sound being periodical and short in duration. Generally, most hi-hat musical devices in the known art operate under the same basic principle in which two cymbals, in their rest or neutral position, are positioned in a separated open manner, actuated by the use of a spring or other mechanism, that is subsequently overcome by the drummer actuating a foot pedal. This pedal is operatively connected to the top or upper cymbal to bring it into contact with the usually stationary lower cymbal. Therefore, the drummer must continuously apply pressure to the hi-hat stand's pedal, achieving the closed hi-hat sound while playing on the cymbals with drumsticks controlled by the hands. The drummer will then occasionally release pressure for a short period of time to achieve the open hi-hat sound with the drumstick to his or her desired rhythm. This process can fully occupy one of the drummer's feet. This requirement is undesirable; restricting the drummer's musical options, but it has been generally accepted and tolerated by many in the percussion instrument world.

A hi-hat musical device solving the problem of allowing a drummer to not have to dedicate one foot chiefly to depressing an actuating pedal of a hi-hat musical device to achieve a closed hi-hat sound with a drumstick, while rarely or only frequently, intermediately lifting the foot to achieve an open hi-hat sound, would allow more freedom for the drummer's foot to play other foot-operated devices in the drum set, such as double basses, a cow bell, or other foot operated instruments. Therefore, with such freedom, a drummer could achieve more complicated rhythms not previously possible with the prior, related, or known technology of traditional hi-hat musical devices. The hi-hat musical device of the present invention solves this problem by functioning in the opposite manner as a traditional hi-hat stand, by acting as an "inverted hi-hat stand" that positions the two hi-hat cymbals disposed or biased against each other in the non-actuated closed position. A foot pedal can then be actuated by the drummer to separate the two cymbals to attain the open sound. Therefore, one foot is used to operate the hi-hat musical device foot pedal only when an open sound is desired instead of during the duration of playing time.

The present invention reverses the input motion from the foot pedal, the actuation lever to the invention, and applies a motion reversal means (e.g. a pulley) to produce the opposite motion of the hi-hat musical devices currently known in the industry while still yielding a similar setup and feel as such conventional devices, in order to free up a drummer's foot for other uses. This opposite motion is accomplished by direct contact without the intermediate step found in the prior art.

A principal objective of this invention, therefore, is to allow a drummer, particularly one who uses a lot of double bass beats or other demanding foot work, to incorporate an open hi-hat sound interchangeably with the usually dominant closed hi-hat sound in any desired rhythm, accomplished without needing an intermediate step to alternate between the two sounds from the same hi-hat musical device. Another advantage of the present invention is to allow the drummer to utilize other foot-operated percussion devices in a drum set, while alternating between the open and closed sounds of the hi-hat musical device without having to restrict a foot for the majority of the time to activate a switch lever or any other intermediate step found in other hi-hat musical devices. The hi-hat musical instrument or device of the present invention, as another objective, allows new and previously unobtainable beats or rhythms for a hi-hat instrument while still achieving current beats or rhythms.

Another objective addressed by the present invention is making the hi-hat musical device feel and react for the drummer as similarly as possible to known hi-hat musical devices on the market while providing the improvements of the present invention, in the simplest form for manufacturability and profitability considerations.

The potential applications of this invention are to produce a percussion musical sound or rhythm. The drummer, as a musician, will apply this invention to the fitting musical situations. This invention's general purpose is assumed to be applied in the music industry but is not limited to uses solely in association with a drum set.

No other patents have been found to teach the improvements of the present invention. Additional art has provided information regarding approaches for playing a hi-hat musical device, but none of the other art provides for the hi-hat musical device elements and functions in the manner as found in the apparatus of the present invention or for use in a related context with a hi-hat musical device. The present invention solves previously mentioned issues by operating in the opposite manner of current hi-hat musical devices.

There is known, related art concerning hi-hat musical devices for use by drummer musicians. However, such art neither discloses nor suggests the present invention as directed to an external motion reversal means, support tube, and operation rod to a hi-hat stand that functions in the manner of the present invention, with cymbal motion opposite that of a conventional hi-hat stand known in the industry. U.S. Pat. No. 7,115,805 to Vandervoort discloses a hi-hat musical device where the cymbals are normally maintained in a closed position and a pulley and cable system is employed to transfer a downward motion on the cable so that the shaft thereto is likewise pulled downward to separate the cymbals, opposite to the cymbal movement of the present invention. The '805 Patent does not function in the same manner as the present invention; which is directed to teaching the disposing of the motion reversal means exterior of the support system, and connected to a central operating rod extending the length of the tube and connected to a cymbal. The '805 Patent does not use a direct connection to actuate the cymbals to achieve a cymbal separation motion in the manner of the present invention. As well, the arrangement of the '805 Patent cymbal setup is nothing like what a "drum set drummer" typically is familiar with, not having a feel or sound as desired by drummers, and therefore not in an arrangement consistent with use by drummers familiar with the art. For example, the setup of the '805 Patent would not be desired if a drummer wants the diverse sounds and controls accomplished by a traditional hi-hat, as achieved by the present invention.

U.S. Pat. No. 6,320,109 to Kuppers discloses a triple hi-hat operating mechanism including a deflection roller, a pulley mechanism, and string mechanism disposed interior of the central tube. Although the '109 Patent makes use of a deflection roller, it does not function in the same manner as the present invention and is not used in any manner that would enable a drummer to produce sounds and controls similar to a traditional hi-hat musical device as known to those in the art, but rather it produces alternative sounds.

Nor is the '805 Patent readily adaptable to other devices, such as the '109 Patent. The deflection roller of the '109 Patent is spring biased and shares no similarity in structure to the '805 Patent. The present invention employs an elongated operation rod extending centrally in the lower portion of the support tube, and directly connected proximal to a second, free end to the upper cymbal. Accordingly, the prior art neither discloses nor suggests the present invention as directed to a motion reversal means mounted to the exterior of the support tube and connected to a central operation rod extending the length of the support tube and connecting to a cymbal.

U.S. Pat. No. 6,878,868 to McMillan discloses a portable hi-hat musical device in which cymbals are caused to be separated upon depression of an arm connected to a cable that actuates a spring loaded spindle housed between a pair of collars. The '868 patent uses a depression arm and a cable that separates hi-hat cymbals, but is done by an intermediate step with the use of a hand, inhibiting the drummer's movement and, thereby, his rhythm. U.S. Pat. No. 7,094,959 to Marnell discloses an alternating cymbal arrangement in which bottom cymbal is released from the top cymbal upon depression of a foot pedal and re-engaged with the top cymbal upon release of the foot pedal. Although the device of the '959 Patent employs a chain and rod mechanism, the rod is not coaxial with the central tube. As well, the '959 Patent has cymbals that, while normally in contact with each other, are not arranged to be struck by a drummer using a drumstick, and, thus, do not achieve traditional hi-hat sounds common to the prior art, such as the open and closed cymbal sounds of the present invention. The sound produced by the '959 Patent is limited to only one sound, a "click" sound.

U.S. Pat. No. 4,497,238 to Dasovich allows the hi-hat stand to have the cymbals in contact with one another in a neutral position, and the cymbals can be separated for the duration of a force or pressure applied to the foot pedal. Patent '238 accomplishes a function similar to the present invention but in a different way, by having the lower cymbal move away from a stationary upper cymbal. U.S. Pat. No. 4,817,490 to Cahill indicates that the hi-hat stand keeps the two cymbals in the closed state in the ready or neutral position, but does so using a cam, producing multiple beats per cycle of the foot pedal, not one, as in the present invention.

U.S. Pat. No. 6,316,708 to Kuppers is similar to the '238 Patent in that both allow the cymbals to be actuated, but in a variable manner. The '708 Patent also has a guide pulley that converts downward motion into an upward motion; however, this guide pulley is used to move the lower cymbal, and the cymbals are only guided against each other, not away, with the actuation of the foot pedal, functioning in a completely different manner than the present invention, and thereby not addressing the problems or objections solved hereby. The present invention moves the top cymbal away from the lower cymbal, instead of the traditional process of the '708 Patent, moving the upper cymbal into contact with the lower cymbal, and thereby creating less movement and different sounds.

Some of the prior art does allow a drummer to alternate between the opened and closed sound, but it only does so by an intermediate step or by restricting one's foot to continuously engage these hi-hat stands. The '238 Patent includes a reversible high-hat cymbal stand, actuating the lower cymbal to separate from the stationary upper cymbal, but without the use of a pulley to translate the motion, as in the present invention. The design of the '238 Patent is complicated, requiring an operator to switch modes in a time consuming and cumbersome manner, rendering such a device impractical. U.S. Pat. Nos. 5,415,072 and 7,126,050 to Huang and Lombardi, respectively, provide for the use of what is commonly known as a drop clutch, allowing the upper cymbal to be disconnected from the operating rod by means of a lever, to drop into contact with the lower cymbal. Thus, these patents operate in a completely different manner and do not solve the problem of requiring an intermediate step. Therefore there is no quick and smooth transition between desired sounds by the use of these two patents.

The foregoing and other objectives, advantages, aspects, and features of the present invention will be more fully understood and appreciated by those skilled in the art upon consideration of the detailed description of a preferred embodiment, presented below in conjunction with the accompanying drawings.

SUMMARY OF THE INVENTION

The problem of allowing a drummer to not have to dedicate one foot chiefly to depressing an actuating foot pedal of a hi-hat musical device is solved by applying a motion reversal means to cymbals disposed against each other in the non-actuated closed position, to actuate a foot pedal to separate the cymbals. A musical operator can apply force to the hi-hat musical device of the present invention to actuate the upper cymbal away from the lower cymbal to create a desired open sound, when the drummer strikes the cymbals with a drumstick. In order to accomplish this result, the hi-hat musical device of the present invention comprises a foot pedal, a motion reversal means and a hi-hat stand, which said stand is further comprised of a support tube, an operation rod, an upper cymbal and a lower cymbal, and a support structure means. Each of the cymbals has a convex side and a concave side. The concave sides to the upper cymbal and lower cymbal are opposingly disposed against each other in a closed non-actuated position. The upper cymbal and lower cymbal are positioned horizontally along the operation rod. The upper cymbal is cooperatively attached to the operation rod.

The motion reversal means comprises a motion reversal mechanism, an attachment member, and a foot pedal linkage means. The foot pedal has a hinged end and an opposing connected end, the connected end being cooperatively linked to the foot pedal linkage means. The motion reversal mechanism may be a pulley mechanism or other commonly known mechanisms in other industries, such as cams, gears, or a pivoted seesaw mechanism. The foot pedal linkage means is operatively linked from the foot pedal to the operation rod around the motion reversal means, causing the operation rod and the attached upper cymbal to move upward in an upward cymbal motion, thereby separating the upper cymbal and the lower cymbal vertically into an open actuated position, the forced or biased position, when a drummer depresses the foot pedal downward by a downward pedal motion. The motion reversal means translates the downward pedal motion into the opposing upward cymbal motion, placing the upper and lower cymbals in the open actuated position, allowing the drummer to produce an open cymbal sound when striking the upper and lower cymbals, and to produce a closed cymbal sound when releasing the foot pedal, returning said cymbals to the closed non-actuated position. The upward cymbal motion is produced via direct connection, without the intermediate step of other hi-hat musical devices currently known in the industry, while still yielding a similar setup and feel as such conventional devices, with the upper cymbal moving up into contact with the striking of a drumstick, to free up the foot of the drummer for other uses.

By making use of gravity, or other biasing means such as springs, to keep the cymbals in constant contact while in the neutral or closed non-actuated position, the hi-hat musical device allows the drummer to achieve the hi-hat closed cymbal sound, without having to apply any force to the hi-hat stand, such as by use of the drumstick, except when the open cymbal sound is desired. Therefore, when the drummer wants an open cymbal sound, he or she can step on the foot pedal, to continuously apply the downward pedal motion for the duration of the desired, open cymbal sound.

Downward pedal motion of the depressed foot pedal pulls down on the foot pedal linkage means. When the foot pedal is depressed, moving the connected end to the foot pedal downward, the foot pedal linkage means raises the operation rod. The upper cymbal, attached to the operation rod by the cymbal attachment means, in turn, moves upward away from the stationary lower cymbal. As soon as the downward pressure, induced by the downward pedal motion, is released from the foot pedal by the foot of the drummer, the upper cymbal falls, moving back into contact with the lower cymbal.

The invention may be used in particular advantage in a remote manner in another particular embodiment, wherein the hi-hat musical device is remotely operated, and alternatively comprises the foot pedal linkage means comprising a flexible sheath connecting to the foot pedal at the connected end and to a housing cord at an opposite, second sheath end to remotely and cooperatively connect the foot pedal to the motion reversal mechanism.

Hi-hat stand devices are commonly known in a stationary style where cymbals are mounted directly above a cymbal actuating foot pedal. If desired, particular embodiments may optimally include a tilt adjuster means proximal to the support end of the support tube for adjusting the upper and lower cymbals to an angled position.

If desired, other particular embodiments may optimally include the support tube comprising an upper telescoping tube sliding operatively and vertically within a lower telescoping tube, the said lower tube vertically securing said upper tube in position with a releasable tightening means. The lower telescoping tube also allows the mounting of the support structure means, along with the motion reversal means and the foot pedal.

The general use of this hi-hat musical device is in a drum set comprised of varying percussive instruments to produce musical sounds. It can be used as the sole hi-hat stand, or it can also be used with other traditional or current hi-hat stands within the same drum setup.

The aforementioned features, aspects and advantages of the present invention, and further objectives and advantages of the invention, will become apparent from a consideration of the drawings and ensuing description.

BRIEF DESCRIPTION OF THE SEVERAL VIEWS OF THE DRAWINGS

The foregoing features and other aspects of the present invention are explained and other features and objects of the present invention will become apparent in the following detailed descriptions, taken in conjunction with the accompanying drawings. However, the drawings are provided for purposes of illustration only, and are not intended as a definition of the limits of the invention.

DETAILED DESCRIPTION OF THE INVENTION

The present invention will now be described more fully hereinafter with references to the accompanying drawings, in which the preferred embodiment of the invention is shown. This invention may, however, be embodied in different forms, and should not be construed as limited to the embodiments set forth herein. Rather, the illustrative embodiments are provided so that this disclosure will be thorough and complete, and will fully convey the scope of the invention to those skilled in the art. It should be noted, and will be appreciated, that numerous variations may be made within the scope of this invention without departing from the principle of this invention and without sacrificing its chief advantages. Like numbers refer to like elements throughout.

Figure 1:
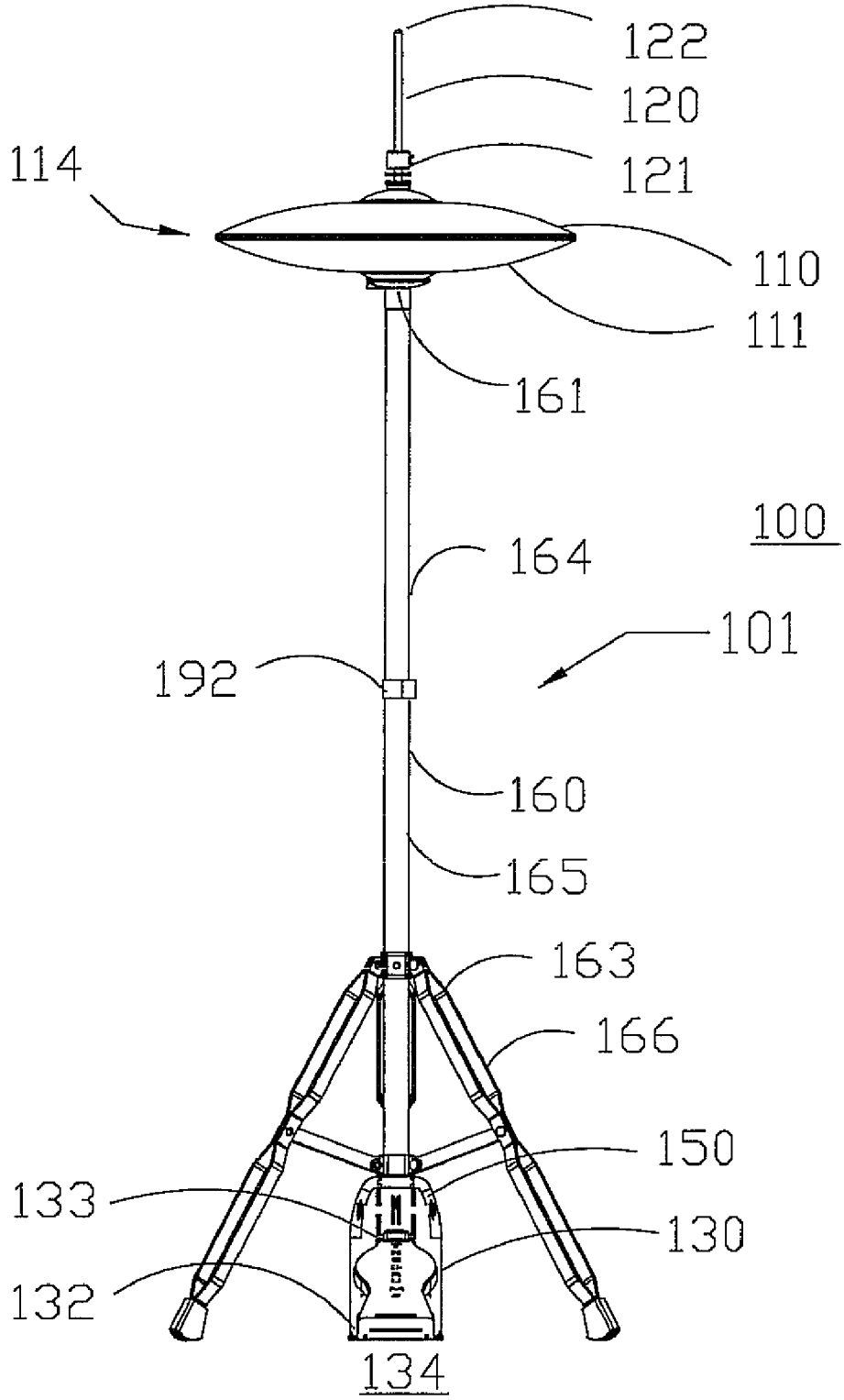
FIG. 1 illustrates one embodiment of the present invention, an elevated front view of the hi-hat musical device.
Figure 2:
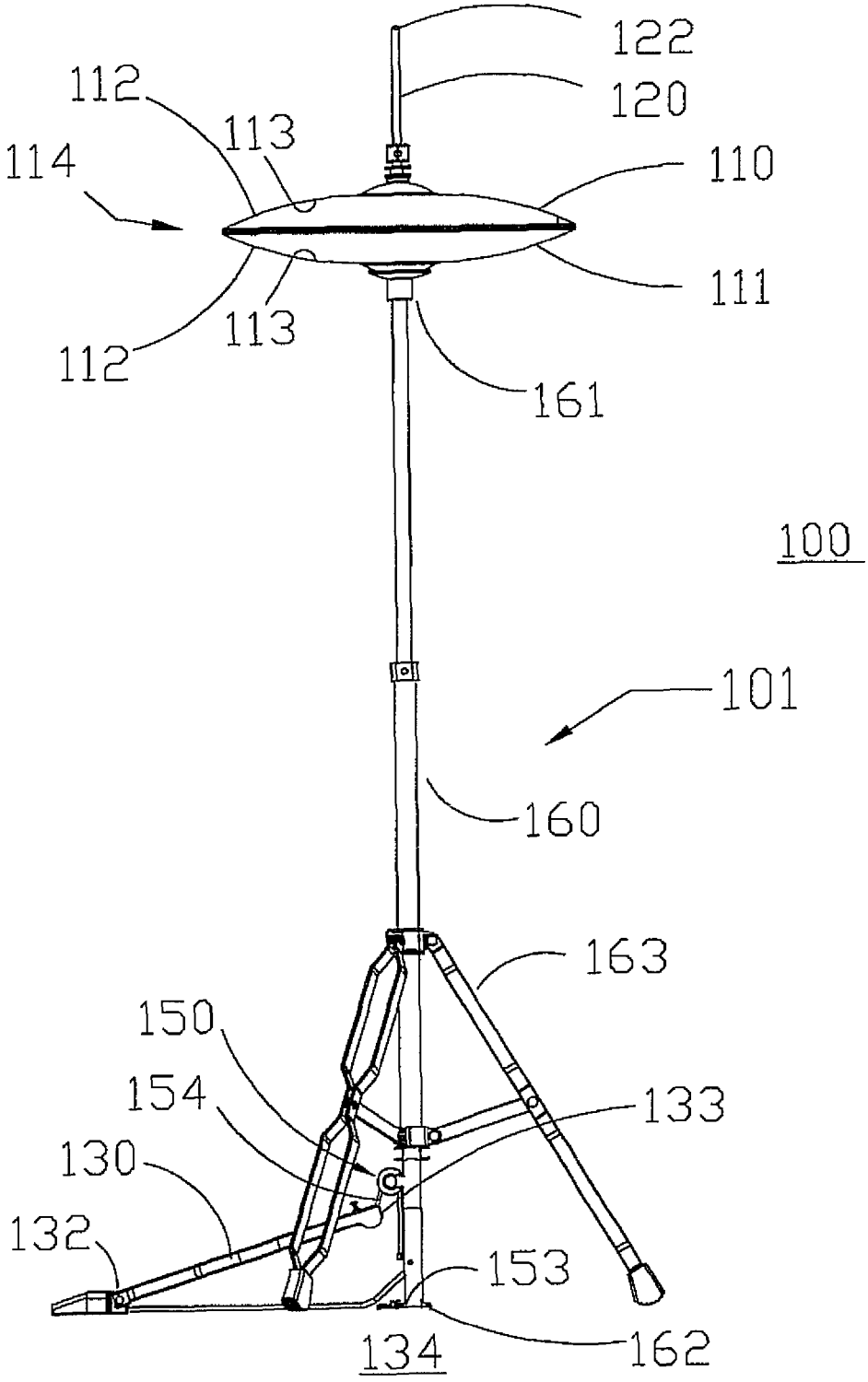
FIG. 2 illustrates one embodiment of the present invention, an elevated side view of the hi-hat musical device.
Figure 3:
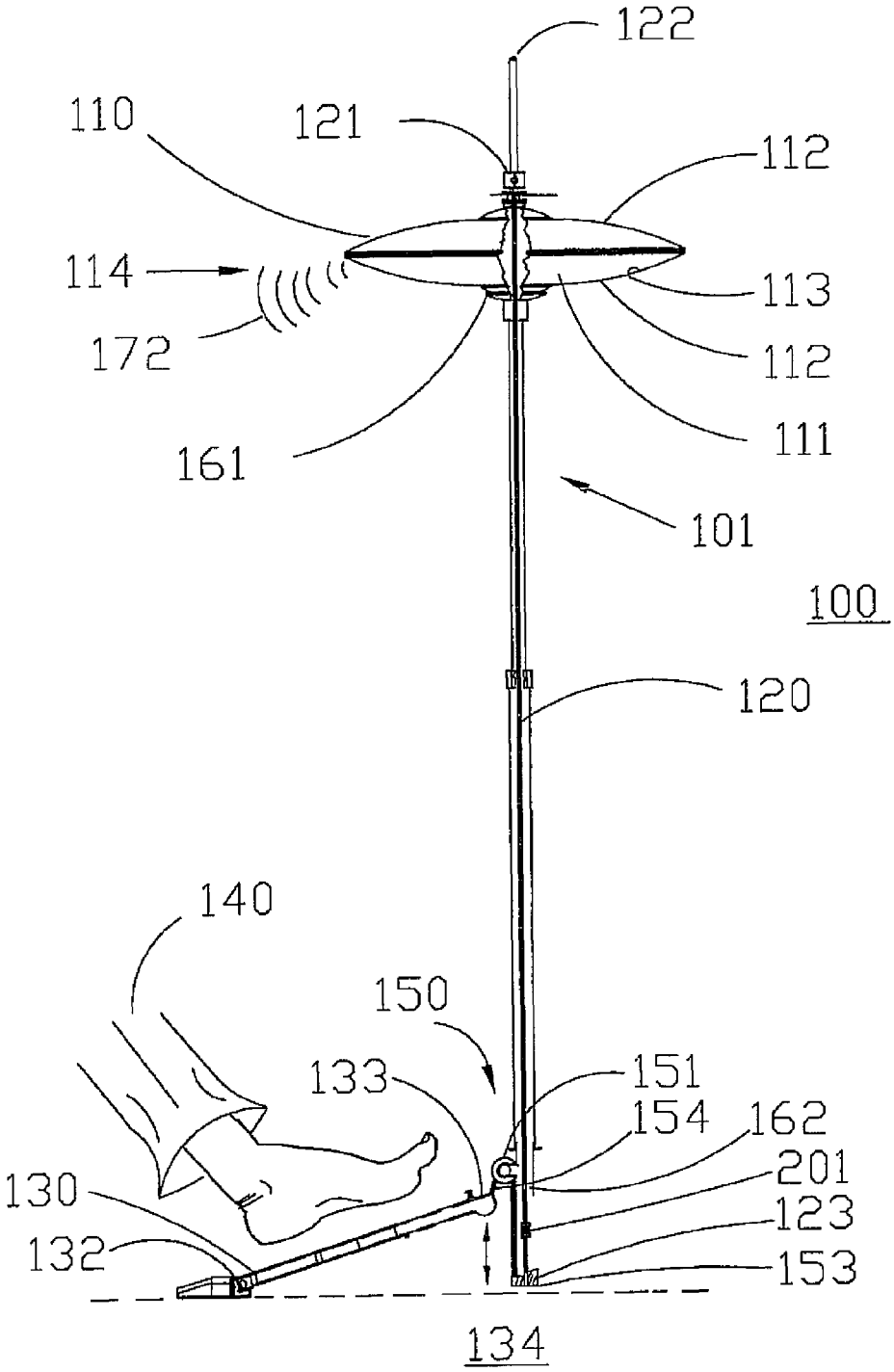
FIG. 3 illustrates one embodiment of the present invention, an elevated side view of the hi-hat musical device. Illustrated in this embodiment are the upper and lower cymbals in a neutral or closed non-actuated position, emitting the closed cymbal sound upon release of the foot pedal by the drummer.

Turning now in detail to the drawings in accordance with the present invention, one embodiment of the present invention is depicted in FIGS. 1 and 2, are elevated front and side views, respectively, of the hi-hat musical device 100. The hi-hat musical device 100 comprises a foot pedal 130, a motion reversal means 150 and a hi-hat stand 101, which said stand 101 is further comprised of a support tube 160, an operation rod 120, (fully depicted in FIG. 3), an upper cymbal 110 and a lower cymbal 111, and a support structure means 163. Each of said cymbals 110 and 111, respectively, has a convex side 112 and a concave side 113, as shown in FIG. 3. The concave sides 113 to the upper cymbal 110 and lower cymbal 111 are opposingly disposed against each other in a closed non-actuated position 114, also termed the neutral, rest or unbiased position.

As further shown in FIG. 3, the upper cymbal 110 and lower cymbal 111 are positioned horizontally along the operation rod 120, which has a free end 122 located vertically opposite and above an opposing attached end 123. The upper cymbal 110 is cooperatively attached to the operation rod 120 proximal to its free end 122 by a cymbal attachment means 121. The hi-hat musical device 100 is constructed of rigid metallic materials commonly used in the industry.

In an alternate embodiment of the present invention, a biasing means such as a spring is used as an alternative to gravity, to maintain the upper cymbal 110 in the closed non-actuated position 114, with the lower cymbal 111. Pneumatic or hydraulic mechanisms known in other industries may be employed as alternatives to the biasing mechanism.

Figure 4:
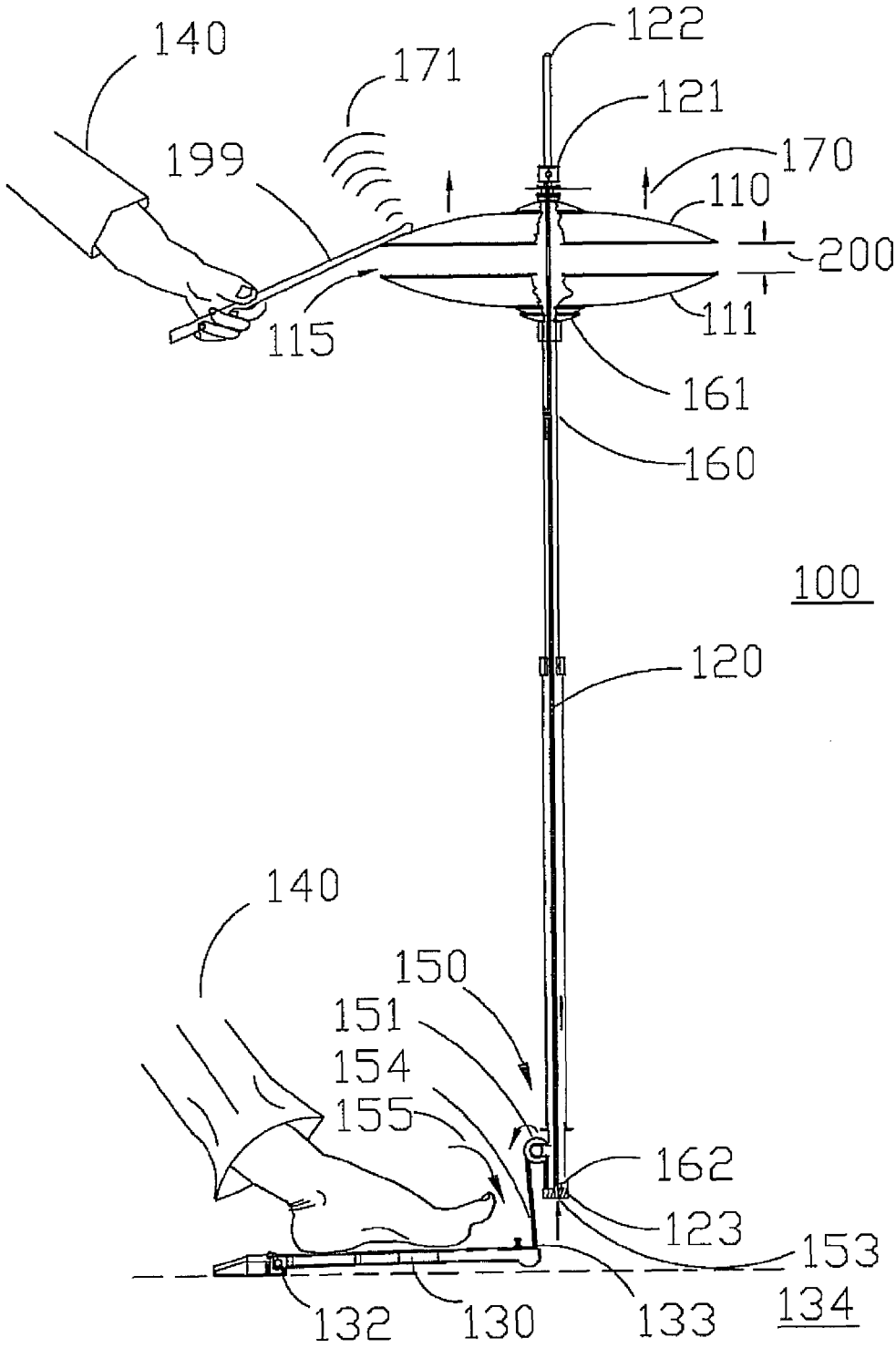
FIG. 4 illustrates, the elevated side view of one embodiment of the present invention of the hi-hat musical device having the upper and lower cymbals in an open actuated position, whereby a drummer may emit the open cymbal sound upon application of the downward pedal motion by striking the drumstick or other instrument on the cymbals.

As further depicted in FIGS. 3 and 4, the motion reversal means 150 comprises a motion reversal mechanism 151, an attachment member 153 connected to the attached end 123 of the operation rod 120, and a foot pedal linkage means 154. The foot pedal 130 (shown in FIGS. 1 through 4) has a hinged end 132 and an opposing connected end 133, the connected end 133 being cooperatively linked to the foot pedal linkage means 154. The foot pedal linkage means 154 is operatively associated with the motion reversal mechanism 151 and is cooperatively and opposingly connected at the attached end 123 to the attachment member 153. The motion reversal mechanism 151 may be a pulley mechanism or other commonly known mechanism in other industries, such as cams, gears, or a pivoted seesaw mechanism. The hinged end 132 is situated on a stable surface 134. The motion reversal mechanism 151 is secured to the hi-hat stand 101, in one embodiment, located proximal to a lower end 162 of the support tube 160. The attachment member 153 may be a horizontal extension piece, a pin, bolt and screw, a weld or other attaching means onto the operation rod 120. Similarly, the motion reversal mechanism 151 may be secured proximal to the lower end support tube 160 by a bolt, screw, weld or other means, commonly known in the industry. In the preferred embodiment of the present invention, the attachment member 153 is a horizontal extension piece of the operation rod 120.

Continuing review of FIGS. 1 and 2, the support tube 160 is vertically positioned and has a support end 161 supporting the lower cymbal 111 toward and proximal to the support end 161, above its lower end 162 which rests on the stable surface 134, commonly a stage floor, bandstand platform, or other surface. The operation rod 120 freely extends coaxially through the support tube 160 above the support end 161 and through the lower cymbal 111. The attachment member 153 is operationally secured to the attached end 123 of the operation rod 120, as shown in FIG. 3.

As shown in FIG. 4, the foot pedal linkage means 154 is operatively linked from the foot pedal 130 to the operation rod 120 by the motion reversal means 150, causing the operation rod 120 and the attached upper cymbal 110 to move upward in an upward cymbal motion 170, thereby separating the upper cymbal 110 and the lower cymbal 111 vertically into an open actuated position 115, the forced or biased position, when a drummer 140 depresses the foot pedal 130 downward by a downward pedal motion 155. In different embodiments of the present invention, the foot pedal linkage means 154 may be a cord, wire, chain, or other material with similar linking characteristics.

As shown in FIGS. 3 and 4, the motion reversal means 150 translates the downward pedal motion 155 from the drummer 140 into the opposing upward cymbal motion 170, placing the upper cymbal 110, in the open actuated position 115, allowing the drummer 140 to produce an open cymbal sound 171 when striking the upper and lower cymbals 110 and 111, and to produce a closed cymbal sound 172 when releasing the foot pedal 130, returning said cymbals 110 and 111 to the closed non-actuated position 114, as shown in FIG. 3.

The present invention is directed to the hi-hat musical device 100 functioning in a manner opposite that of a conventional hi-hat musical device. Downward pedal motion 155 of the depressed foot pedal 130, depicted in FIG. 4, pulls down on the foot pedal linkage means 154. The foot pedal linkage means 154 wraps around a pulley or other motion reversal mechanism 151, said mechanism 151 being located above the connected end 133 opposite the hinged end 132 of the foot pedal 130, and then continues in an approximately vertical downward fashion to where it is connected to the operation rod 120 by the attachment member 153. As the connected end 133 moves downward by the downward pedal motion 155, the connected, opposing attachment member 153 (on the opposite side of the motion reversal means 150) moves cooperatively upward, caused by the reversing or translating of motion of the motion reversal means 150, raising the operation rod 120. At the top of the operation rod 120 is the upper cymbal 110, generally attached by the cymbal attachment means 121, commonly in the form of a hi-hat clutch, known in the industry. The operation rod 120 causes the upper cymbal 110 to move upward away from the stationary lower cymbal 111. As soon as the downward pressure is released from the foot pedal 130, the upper cymbal 110 falls, moving back into contact with the lower cymbal 111.

This upward cymbal motion 170, shown in FIG. 4, is produced via direct connection, without the intermediate step of other hi-hat musical devices currently known in the industry, allowing the drummer 140 to produce an open cymbal sound 171 when striking the upper and lower cymbals 100 and 111, respectively. As soon as the downward pressure is released from the foot pedal 130, the upper cymbal 110 falls, moving back into contact with the lower cymbal 111, the non-actuated position 114, as shown in FIG. 3, to produce a closed cymbal sound 172, accomplished while still yielding a similar setup and feel as such conventional devices, to free up the foot of the drummer 140 for other uses.

Therefore, as shown in FIGS. 1 through 4, the hi-hat musical device 100 reverses the downward pedal motion 155 initiated by a common foot pedal 130 to the upward cymbal motion 170. The motion reversal means 150 can be applied at the bottom of the hi-hat stand 101 proximal to the foot pedal 130 as in the embodiment depicted, or alternatively at the top of the hi-hat stand 101 near the upper and lower cymbals 110 and 111, or anywhere in between along the support tube 160.

The support structure means 163 in the preferred embodiment of the present invention as shown in FIGS. 1 and 2, may be a collapsible tripod of a plurality of legs 166 attached to the support tube 160 proximal to the lower end 162 and seated on the stable surface 134. Other types of support structure means 163, such as a support tube 160 base or other commonly used mechanism may be employed.

Figure 5:
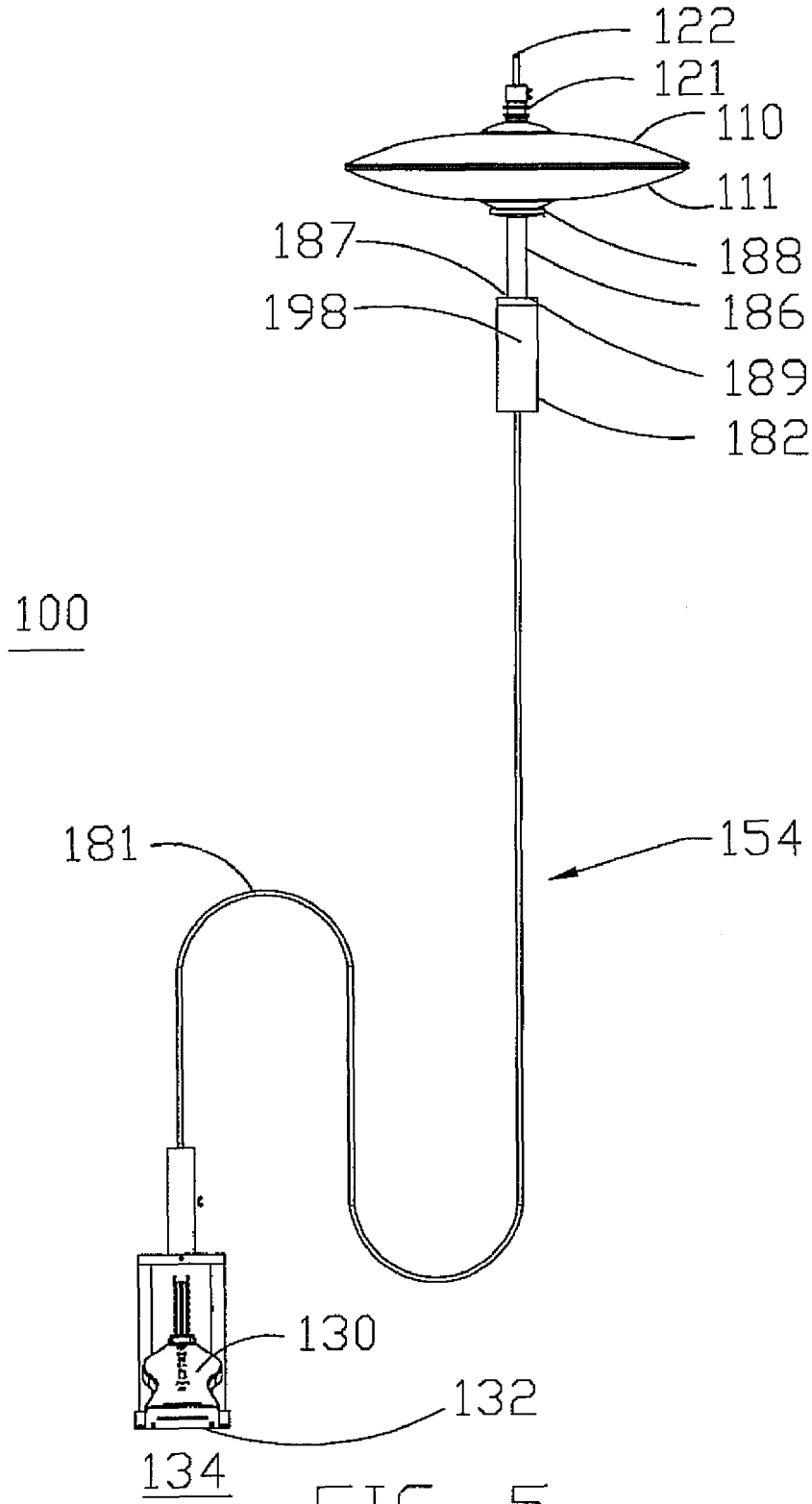
FIG. 5 illustrates another embodiment of the present invention, an elevated front view of the hi-hat musical device having a flexible sheath as part of the foot pedal linkage means to the motion reversal means.
Figure 6:
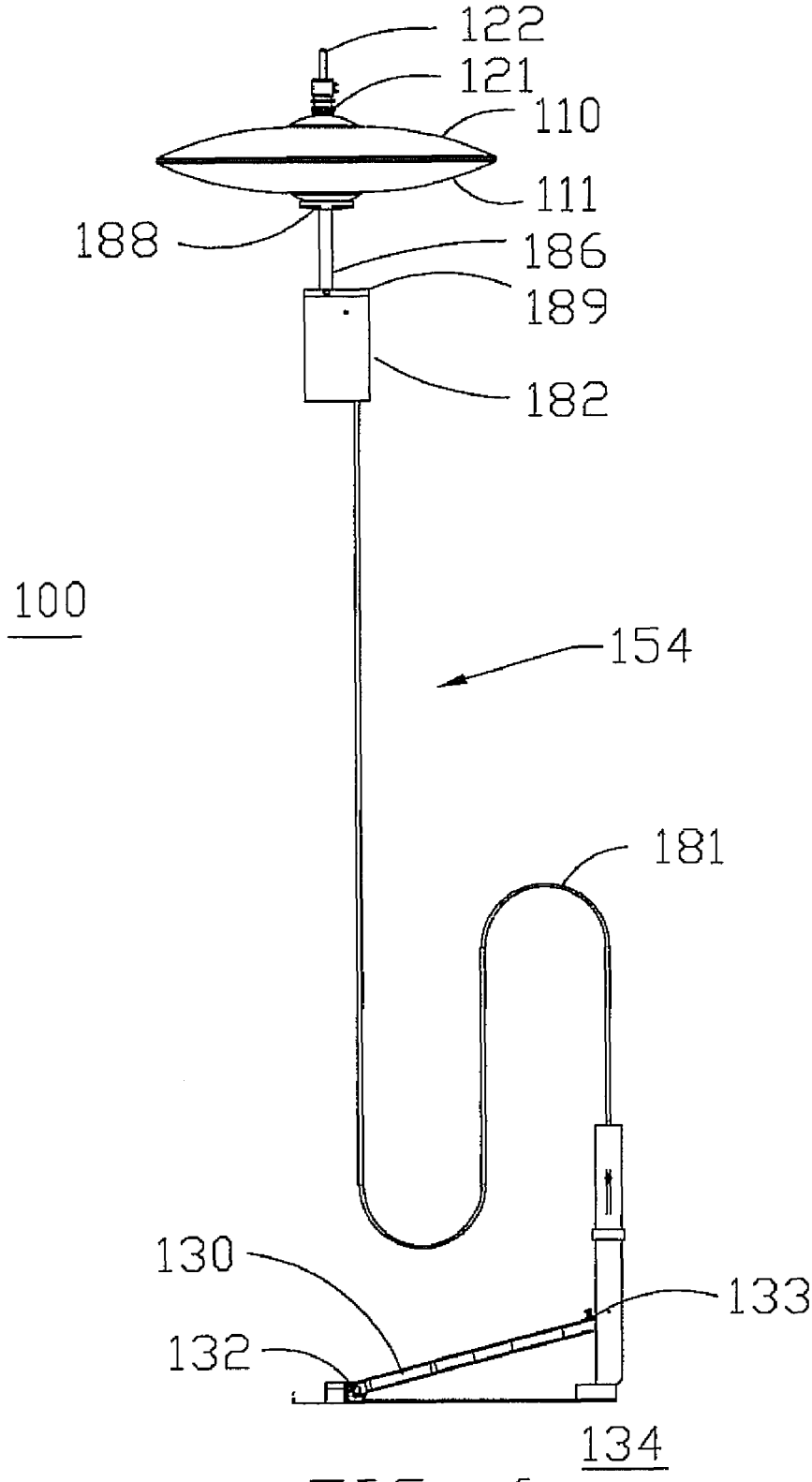
FIG. 6 illustrates another embodiment of the present invention, an elevated side view of the hi-hat musical device having the flexible sheath as part of the foot pedal linkage means to the motion reversal means.
Figure 7:
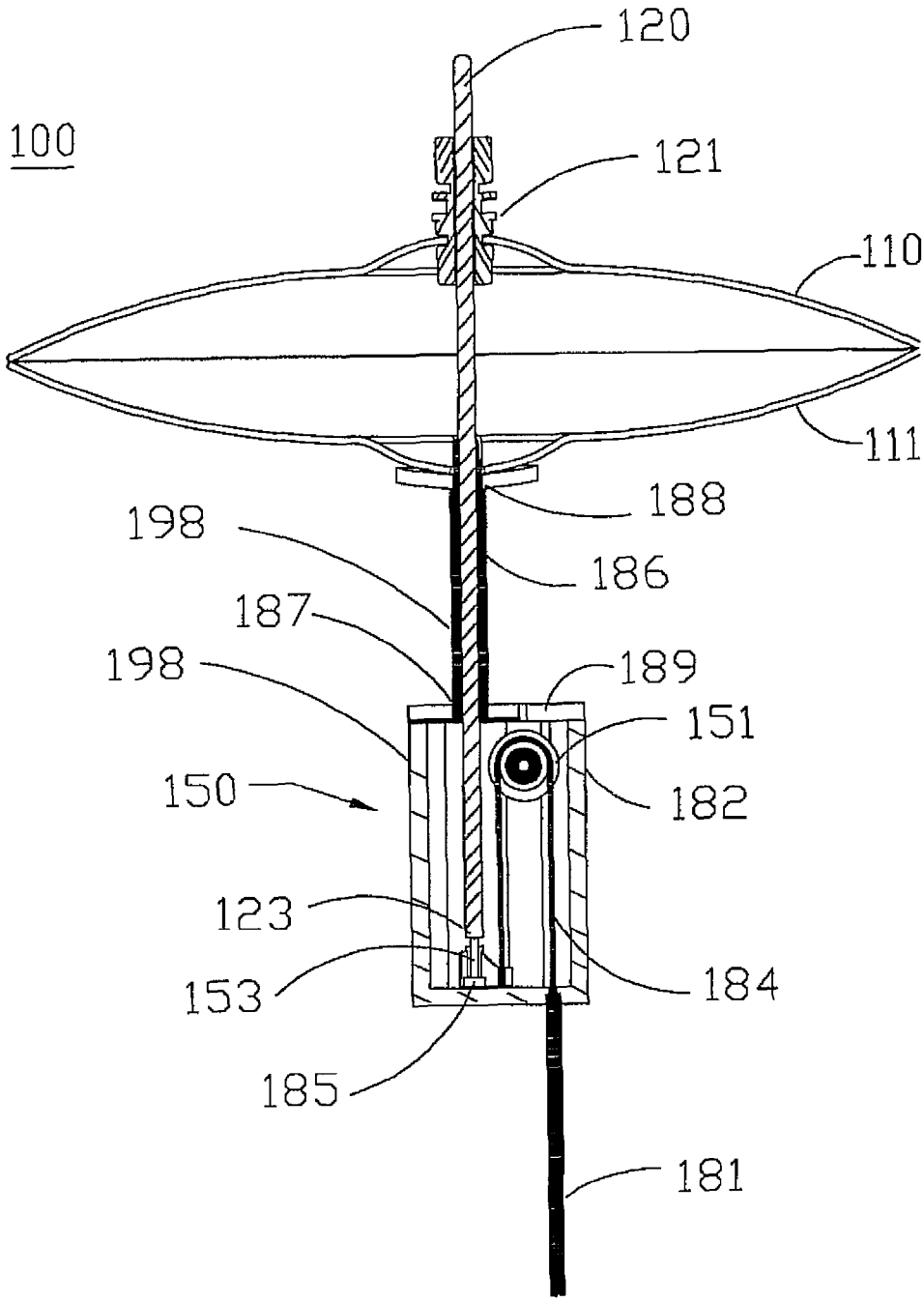
FIG. 7 illustrates another embodiment of the present invention, an elevated side view of the hi-hat musical device having the flexible sheath depicted in FIGS. 5 and 6. Illustrated is a partial, detail view of the interior of the box housing depicting the motion reversal means.

The invention may be used to particular advantage, and the same principles that apply to a stationary hi-hat stand 101 can be applied, in a remote manner in another particular embodiment, as depicted in FIGS. 5 and 6. In this particular embodiment of the present invention, the hi-hat musical device 100 has remotely operated cymbals 110 and 111, and alternatively comprises the foot pedal linkage means 154, comprising a housing cord 184 running coaxially through a flexible sheath 181 and connecting to the foot pedal 130 at the connected end 133, to remotely and cooperatively connect the foot pedal 130 to the motion reversal mechanism 151. As shown in FIGS. 6 and 7, the motion reversal mechanism 151 is housed in a box housing 182, having a top side 189. The sheathed housing cord 184 enters and runs through the box housing 182, acting operationally with the motion reversal mechanism 151 and connected at its opposite cord attachment end 185 to the attachment member 153, which is operatively secured to the attached end 123 of the operation rod 120, that extends up through the lower cymbal 111. The operation rod 120 operates coaxially through an approximately vertical tube 186, which is attached at the top side 189 of the box housing 182, at a housing end 187 of the vertical tube 186. The vertical tube 186 supports the lower cymbal 111 at an opposite cymbal end 188. The box housing 182 and the vertical tube 186 provide a surface area 198 to mount this embodiment of the hi-hat musical device 100, to stands, racks, poles or other commonly known hardware within the field of this invention. The operation rod 120 extends above the lower cymbal 111 where the upper cymbal 110 is attached by the cymbal attachment means 121, as in the preferred embodiment. The hi-hat musical device 100 in this embodiment allows the upper and lower cymbals 110 and 111, respectively, to be variably, removably located away from the foot pedal 130. Hi-hat stand devices are commonly known in a stationary style where cymbals are mounted directly above a cymbal actuating foot pedal. If desired, particular embodiments may optionally include the support tube 160 having a tilt adjuster means proximal to the support end 161 of the support tube 160 for adjusting the upper and lower cymbals 110 and 111, respectively, to an angled position.

As shown in FIG. 1, if desired, particular embodiments may optionally include the support tube 160 comprising an upper telescoping tube 164 sliding operatively and vertically within a lower telescoping tube 165, the said lower tube 165 vertically securing said upper tube 164 in position by a releasable tightening means 192. The lower telescoping tube 165 also allows the mounting of the support structure means 163, along with the motion reversal means 150 and the foot pedal 130. The upper telescoping tube 164 supports the stationary lower cymbal 111. Since the upper telescoping tube 164 can slide up and down within the lower telescoping tube 165, the height of both of said cymbals 110 and 111 can be adjusted by movement of said upper tube 164, whose position is secured with the use of the releasable fastening means 192, such as a wing nut, set screw, or other commonly used fastening means.

The invention may be used to particular advantage by optionally defining a gap 200 between the two cymbals 110 and 111, by the open, actuated position 115 of said cymbals 110 and 111, as depicted in FIG. 4. The gap 200 is controlled by an adjusting means 201, including, but not limited to an adjustable stop located between the attached end 123 of the operation rod 120 and the lower end 162 of the support tube 160, as depicted in FIG. 3, or alternatively, by stopping the travel of the foot pedal 130, or with a control of the drummer's 140 foot. There are many components comprising acceptable alternatives to the adjusting means to achieve this result.

The general use of this hi-hat musical device 100 is in a drum set setup comprised of varying percussive instruments to produce musical sounds. It can be used as the sole hi-hat stand 100, or it can also be used with other traditional or current hi-hat stands within the same drum set setup.

Having thus described in detail a preferred selection of embodiments of the present invention, it is to be appreciated, and will be apparent to those skilled in the art, that many physical changes could be made in the apparatus or the method without altering the invention, or the concepts and principles embodied therein. Unless otherwise specifically stated, the terms and expressions have been used herein as terms of description and not terms of limitation, and are not intended to exclude any equivalents of features shown and described or portions thereof. Various changes can, of course, be made to the preferred embodiment without departing from the spirit and scope of the present invention. The present invention, apparatus, and method, therefore, should not be restricted, except in the following claims and their equivalents.

I claim:

1. A hi-hat musical device, said device comprising:

(a) a foot pedal, a motion reversal means, and a hi-hat stand further comprising a support tube, an operation rod, an upper cymbal, a lower cymbal and a support structure means;

(b) said upper and lower cymbals positioned horizontally along the operation rod, said rod having a free end located vertically opposite and above an opposing attached end, the upper cymbal cooperatively attaching to said rod proximal to its free end by a cymbal attachment means;

(c) each of said cymbals having a convex side and a concave side, the concave sides to the upper cymbal and lower cymbal opposingly disposed against each other in a closed non-actuated position;

(d) the motion reversal means comprising a motion reversal mechanism, an attachment member connecting to the attached end of the operation rod, and a foot pedal linkage means;

(e) the foot pedal having a hinged end and an opposing connected end, said connected end being cooperatively linked to the foot pedal linkage means;

(f) the foot pedal linkage means being operatively associated with the motion reversal mechanism and cooperatively and opposingly linked at the attached end to the attachment member;

(g) the hinged end of the foot pedal being situated on a stable surface;

(h) the support tube being vertically positioned and having a support end supporting the lower cymbal, proximal to the support end, above an opposite lower end resting on the stable surface;

(i) the motion reversal mechanism being secured to the hi-hat stand to the support tube;

(j) the operation rod freely extending coaxially through the support tube above the support end and through the lower cymbal;

(k) the attachment member being operatively secured to the attached end of the operation rod;

(l) the foot pedal linkage being operatively linked from the foot pedal to the operation rod by the motion reversal means, causing the operation rod and the attached upper cymbal to move upward, thereby separating said cymbals vertically into an open actuated position when a drummer depresses the foot pedal downward by a downward pedal motion; and (m) whereby the motion reversal means translates the downward pedal motion from the drummer into an opposing upward cymbal motion, placing said cymbals in the open actuated position, allowing the drummer to produce an open cymbal sound when striking said cymbals, and to produce a closed cymbal sound when releasing the foot pedal, returning said cymbals to the closed non-actuated position.

2. The device of claim 1, wherein a biasing mechanism is used to maintain the upper cymbal in the closed, non-actuated position with the lower cymbal.

3. The device of claim 1, wherein the support structure means further comprises a collapsible tripod of a plurality of legs attached to the support tube proximal to the lower end and said legs seated on the stable surface.

4. The device of claim 1, wherein said device further comprises:

(a) the open, actuated position of said cymbals defining a gap between said cymbals; and (b) an adjusting means controlling the gap.

5. The device of claim 1, wherein the support tube comprises an upper telescoping tube sliding operatively and vertically within a lower telescoping tube; said lower tube vertically securing said upper tube in position by a releasable tightening means.

6. A hi-hat musical device, said device comprising:

(a) a foot pedal, a motion reversal means, an operation rod, an upper cymbal and a lower cymbal;

(b) said upper and lower cymbals positioned horizontally along the operation rod, said rod having a free end located vertically opposite and above an opposing attached end, the upper cymbal cooperatively attaching to said rod proximal to its free end by a cymbal attachment means;

(c) each of said cymbals having a convex side and a concave side, the concave sides to the upper cymbal and lower cymbal opposingly disposed against each other in a closed non-actuated position;

(d) the motion reversal means comprising a motion reversal mechanism, and attachment member connecting to the attached end of the operation rod, and a foot pedal linkage means;

(e) the foot pedal having a hinged end and an opposing connected end, said connected end being cooperatively linked to the foot pedal linkage means;

(f) the hinged end of the foot pedal being situated on a stable surface;

(g) the foot pedal linkage means comprising a housing cord running coaxially through a flexible sheath connecting to the foot pedal at the connected end, to remotely and cooperatively connect the foot pedal to the motion reversal mechanism;

(h) the motion reversal mechanism being housed in a box housing having a top side;

(i) the housing cord entering and running through the box housing and acting operationally with the motion reversal mechanism;

(j) the housing cord being connected at an opposite cord attachment end to the attachment member operatively secured to the attached end of the operation rod;

(k) the operation rod extending up through the lower cymbal and operating coaxially through an approximately vertical tube attached to the top side of the box housing at a housing end of the vertical tube;

(l) the vertical tube supporting the lower cymbal at an opposite cymbal end;

(m) the box housing and vertical tubing providing a surface area to mount the hi-hat musical device;

(n) the foot pedal linkage being operatively linked from the foot pedal to the operation rod by the motion reversal means, causing the operation rod and the attached upper cymbal to move upward, thereby separating said cymbals vertically into an open actuated position when a drummer depresses the foot pedal downward by a downward pedal motion;

(o) the motion reversal means translating the downward pedal motion from the drummer into an opposing upward cymbal motion, placing said cymbals in the open actuated position, allowing the drummer to produce an open cymbal sound when striking said cymbals, and to produce a closed cymbal sound when releasing the foot pedal, returning said cymbals to the closed non-actuated position; and (p) whereby the upper and lower cymbals, respectively, are variably located away from the foot pedal and remotely operated.

* * * * *

UNITED STATES PATENT AND TRADEMARK OFFICE

CERTIFICATE OF CORRECTION

PATENT NO. : 8,198,522 B2
APPLICATION NO. : 12/910500
DATED : June 12, 2012
INVENTOR(S) : Christopher Joel Michael It is certified that error appears in the above-identified patent and that said Letters Patent is hereby corrected as shown below:

Title Page

Item (76) the word "Allen" should be changed to "Joel".

Signed and Sealed this
Twenty-fourth Day of November, 2015

Michelle K. Lee

Michelle K. Lee
*Director of the United States Patent and Trademark Office*